US005361954A

United States Patent [19]

Tura

[11] Patent Number: 5,361,954

[45] Date of Patent: Nov. 8, 1994

[54] SKI HOLDER DEVICE

[76] Inventor: Gilberto Tura, Via Pieve, 17, 40054 Budrio (Prov. of Bologna), Italy

[21] Appl. No.: 48,528

[22] Filed: Apr. 20, 1993

[30] Foreign Application Priority Data

Apr. 22, 1992 [IT] Italy ..... BO92 U 000082

[51] Int. Cl.[5] ..... A45F 3/04; E05B 73/00

[52] U.S. Cl. ..... 224/191; 224/917; 224/202; 224/151; 224/257; 224/235; 280/814; 294/147

[58] Field of Search ..... 224/917, 151, 191, 202, 224/207, 208, 235, 242, 247, 257; 294/147; 280/814

[56] References Cited

U.S. PATENT DOCUMENTS

| | | | |
|---|---|---|---|
| Re. 30,523 | 2/1981 | Rich | 280/814 X |
| 3,504,405 | 4/1970 | Elliott-Smith | 224/917 X |
| 3,936,067 | 2/1976 | Link | 280/814 |
| 4,171,079 | 10/1979 | Dietlein et al. | 280/814 |
| 4,175,683 | 11/1979 | Shields | 294/147 X |
| 4,470,528 | 9/1984 | Dyess | 224/257 |
| 4,982,883 | 1/1991 | Ullal et al. | 224/917 X |

FOREIGN PATENT DOCUMENTS

| | | | |
|---|---|---|---|
| 2351679 | 1/1978 | France | 280/814 |
| 2577127 | 8/1986 | France | 294/147 |
| 2734212 | 2/1979 | Germany | 280/814 |
| 2824642 | 12/1979 | Germany | 280/814 |
| 2827182 | 1/1980 | Germany | 280/814 |
| 27078 | 7/1916 | Norway | 280/814 |
| 428755 | 12/1974 | U.S.S.R. | 280/814 |

*Primary Examiner*—Ernest G. Cusick

*Attorney, Agent, or Firm*—Guido Modiano; Albert Josif; Daniel O'Byrne

[57] ABSTRACT

Device comprising two clasps which are fixed to two skis to form two cavities suitable to accommodate an element which is connected to a shoulder strap; the strap is provided with an element for adjusting its length, and the element is provided with two elastic structures which are suitable to be engaged in the two cavities of the two skis, which are suitable to contain, as an alternative to the element, an anti-theft device; a buckle element is provided in a belt for accommodating the element extracted from the cavities.

14 Claims, 4 Drawing Sheets

SKI HOLDER DEVICE

BACKGROUND OF THE INVENTION

The present invention relates to an ergonomic device which is suitable to facilitate carrying items, particularly skis, and is suitable to cooperate with a key device and with a chain to form an anti-theft device for one or more pairs of skis and for the associated ski-sticks. The device is suitable, in particular, to be applied to a pair of elongated members, such as two skis, and can be used to engage an element of a buckle arranged at the end of a traction element of a shoulder-strap in order to easily support a pair of skis. More advantageously, it can be used to protect the two skis against theft.

SUMMARY OF THE INVENTION

In summary, the problems that the device according to the present invention aims to solve are the following:

1—providing an element of a buckle to accommodate the second element of said buckle, which is at the end of a traction element;

2—forming a device meant to keep together two skis to be supported or protected against theft;

3—providing a device particularly suitable to be used to easily support and protect against theft a pair of skis.

BRIEF DESCRIPTION OF THE DRAWINGS

Further characteristics and advantages of the present invention will become apparent from the following description of a preferred but not exclusive embodiment of the device, with reference to the accompanying drawings, in which generally.

DESCRIPTION OF THE PREFERRED EMBODIMENTS

Figure 1:
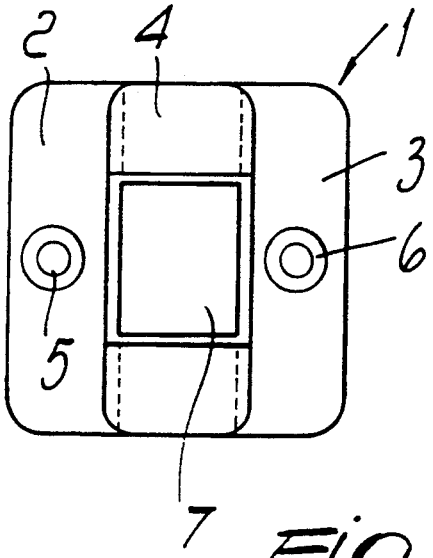
FIG. 1 is a top view of a clasp of the device according to the present invention.
Figure 2:
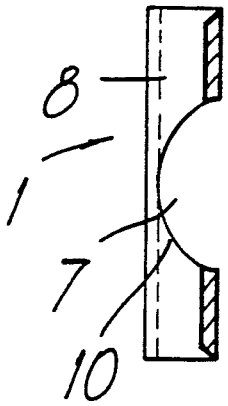
FIG. 2 is a first partially sectional side view of the clasp.
Figure 3:
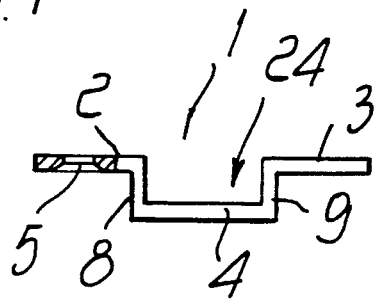
FIG. 3 is a second partially sectional side view of the clasp.

The clasp shown in FIGS. 1, 2 and 3 is constituted by a plate 1 comprising two lateral and co-planar flaps 2 and 3, and a central wall 4, which is rigidly coupled to the two flaps 2 and 3 by means of two walls 8 and 9 and extends on a plane which is parallel to the one on which said flaps extend.

Two through holes 5 and 6 are provided in the two flaps 2 and 3 to accommodate two fixing screws. An opening 7 is formed in the central part 4 and also affects the walls 8 and 9 which respectively connect the flaps 2 and 3 to the central wall 4. In the walls 8 and 9, the opening 7 is shaped like a sector 10.

Figure 4:
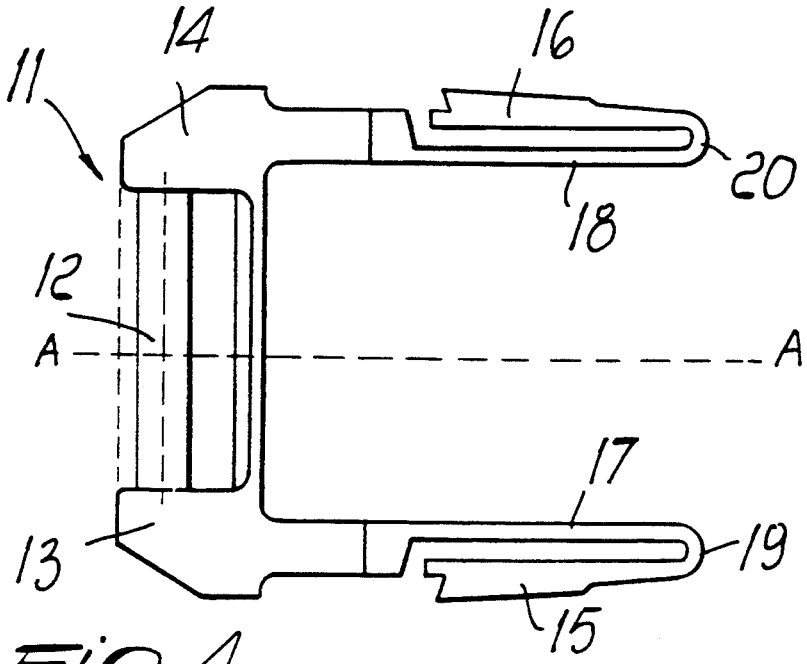
FIG. 4 is a view of a male element of a buckle which is insertable into the clasp.

FIG. 4 shows a male element 11 of a buckle which is insertable in two clasps shown in the preceding figures. The element 11 comprises a cylinder 12, rigidly coupled to two shoulders 13 and 14 provided in the element 11, and two elastic structures 15 and 16, which are symmetrical with respect to a plane of symmetry A—A of the element 11.

The elastic structures 15 and 16 are connected to the shoulders 13 and 14 by means of rods 17 and 18. Two arc-shaped portions 19 and 20 are provided respectively between the structure 15 and the rod 17 and between the structure 16 and the rod 18 to allow the structures 15 and 16 to flex inward at right angles to the plane of symmetry A—A.

Figure 5:
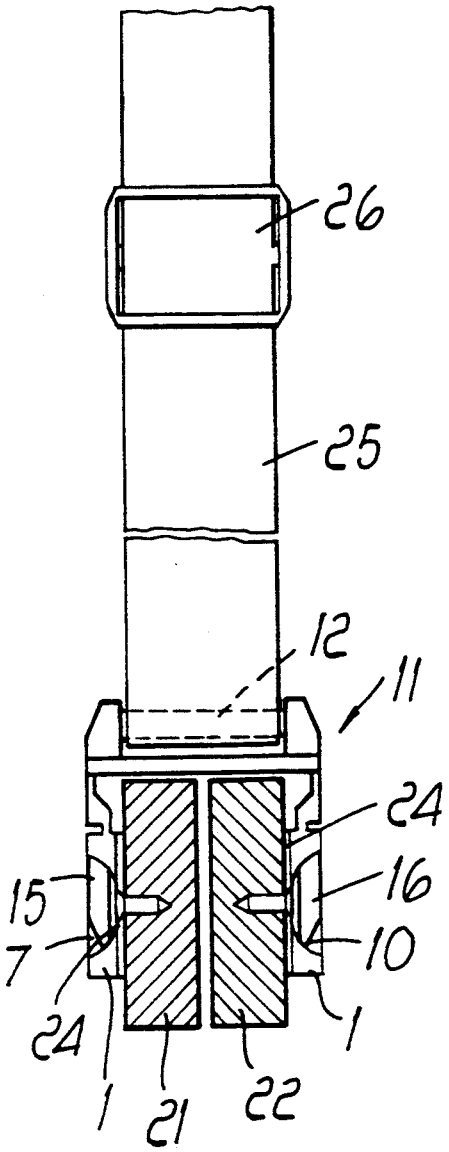
FIG. 5 is a side view of two plates constituting two clasps supporting two skis and wherein an element of a buckle, arranged at one end of a traction element of a strap, is inserted.
Figure 6:
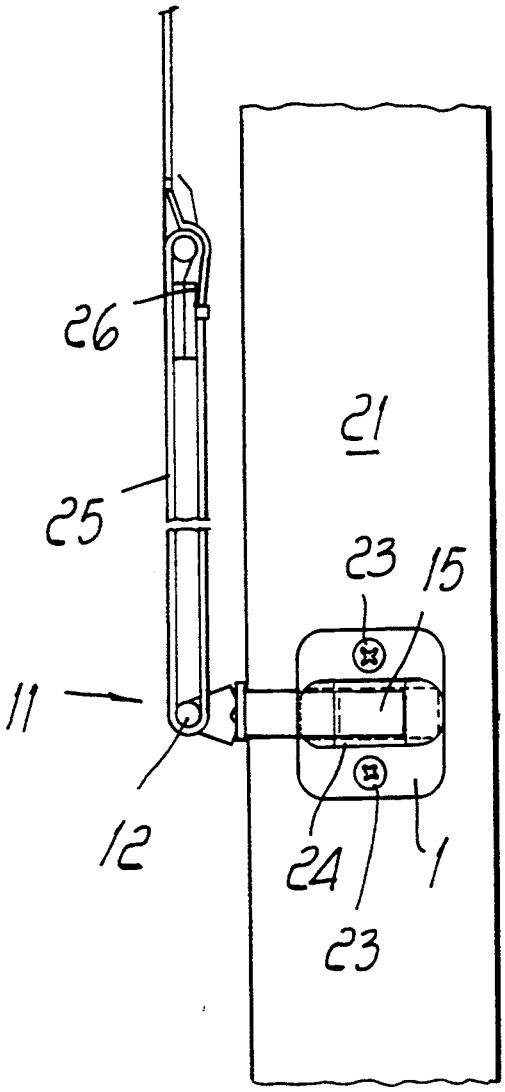
FIG. 6 is a front view of one of the two clasps of FIG. 5.

FIGS. 5 and 6 show two clasps 1 fixed to two skis 21 and 22 by means of screws 23; the elastic structures 15 and 16 have been inserted in the openings 7 of the clasps 1 in order to fix the male element 11 to the two clasps 1 so as to keep the two skis 21 and 22 together.

The element 11 is inserted in the clasps 1 by arranging the elastic structures 15 and 16 in the cavities 24 formed by the internal surfaces of the walls 4 and by the external surfaces of the skis 21 and 22, by sliding the element 11 downward until the structures 15 and 16 engage in the openings 7 with a snap-together action. To extract the element 11 it is necessary to push the structures 15 and 16 at right angles to the plane of symmetry A—A until they disengage from the respective openings 7, and the element 11 is moved upward until it is extracted from said cavities 24.

Advantageously, the element 11 is provided with the cylinder 12 on which the end of a traction element 25 engages; said end is provided with an element 26 for adjusting the length of said traction element 25. By virtue of these means it is possible to support the skis 21 and 22 easily and effortlessly, as will become apparent hereinafter with reference to FIG. 10.

Figure 7:
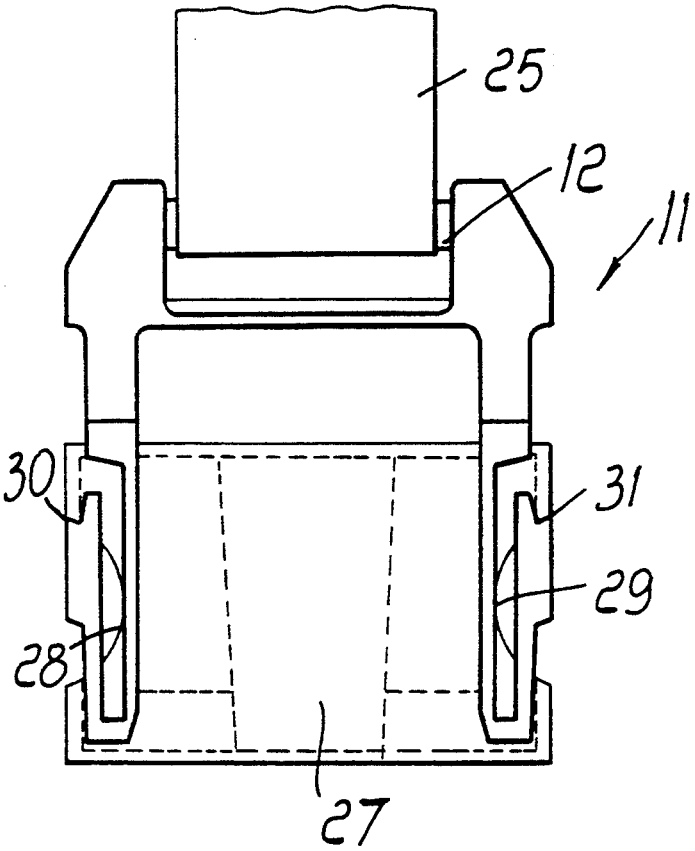
FIG. 7 is a front view of the buckle element inserted in a second buckle element applied to a belt.
Figure 8:
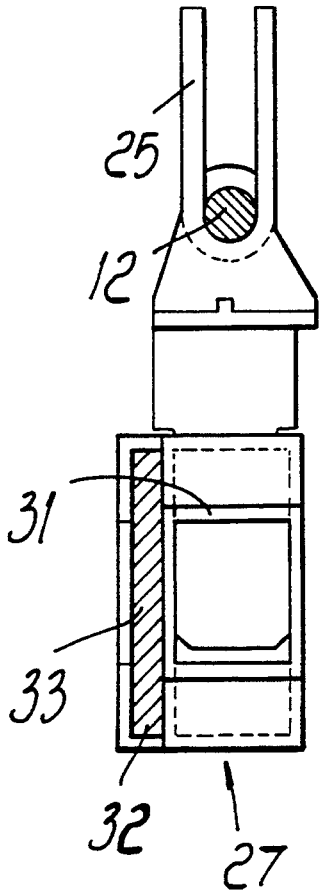
FIG. 8 is a side view of the buckle element of FIG. 7.

In FIGS. 7 and 8, the element 11 is inserted in a female element 27 of a buckle with its internal parts outlined with dashed lines. The element 27 has two semicircular lateral openings 28 and 29 on the edges of which two teeth, respectively 30 and 31, of the elastic structures 15 and 16 engage to retain the element 11 inside the element 27. The element 11 is inserted and extracted with respect to the element 27 in the manner described for the insertion and extraction of said element 11 with respect to the clasps 1. It should be specified that the teeth 30 and 31, which are not shown in FIGS. 5 and 6, cause the coupling of the element 11 to the clasps 1 to be stable.

The element 27 is supported by a strip 32 inserted in a tubular through cavity 33 provided in said element 27. The strip 32 is shown in cross-section in FIG. 8.

Figure 9:
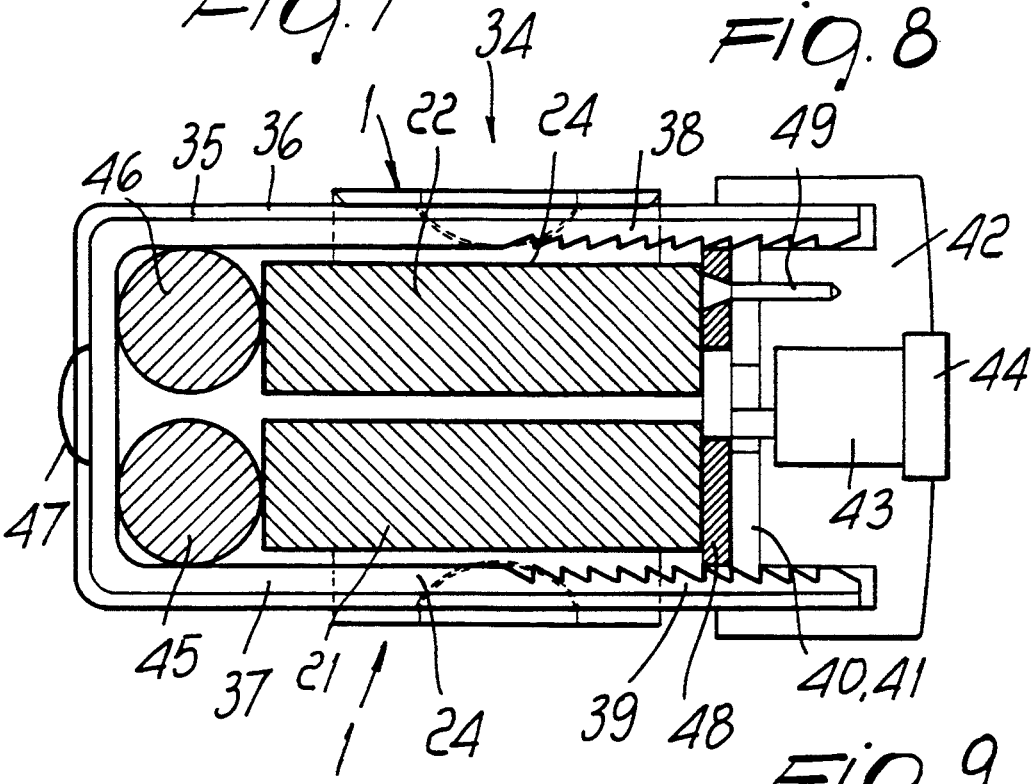
FIG. 9 is a schematic view of an anti-theft device inserted in the clasps.

An anti-theft device 34, shown in FIG. 9, can be engaged in the cavities 24 formed by the internal surfaces of the walls 4 and by the external surfaces of the skis 21 and 22. The device 34 is constituted by a C-shaped structure 35 in which the two open sides of the C, designated by the reference numerals 36 and 37, are insertable into said cavities 24 and are provided with mutually facing teeth 38 and 39. The teeth 38 and 39 respectively accommodate the end of two oppositely arranged bolts 40 and 41 the profile of which is identical to the profile of said teeth. The bolts 40 and 41 are part of a key-operated lock 42 which is provided with a plug 43, with a keyhole 44 and with a system, which is known and not shown, for moving the ends of the bolts 40 and 41 from a first engagement position to a second disengagement position with respect to the teeth 38 and 39 and vice versa. The lock 42 furthermore has a plate 48 which is rigidly coupled, through screw means 49 (shown schematically), to said lock 42 to allow correct placement and operation of the bolts 40 and 41.

Advantageously, the first engagement position is reached through spring-latch means which allow a stepwise axial movement of the bolts 40 and 41 toward the inside of the C-shaped element. The second position is reached by acting with the key on the lock to move said bolts toward the outside of the C-shaped element.

The structure 35 can also contain two ski sticks 45 and 46 conveniently arranged next to the skis 21 and 22.

The use of the clasps 1 is particularly advantageous for supporting a pair of skis and a pair of ski-sticks and protecting them against theft. It is evident that while reference is made herein to skis 21 and 22, and ski sticks 45 and 46, the device may be employed for holding other implements or sports equipment.

Figure 10:
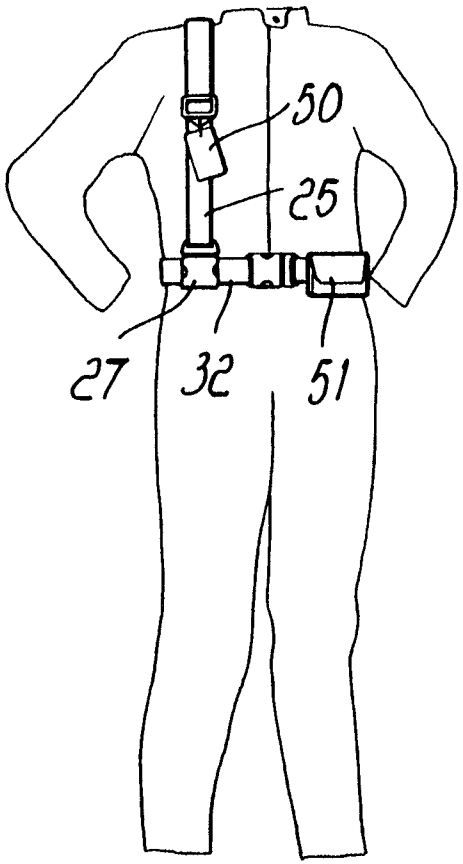
FIG. 10 is a view of a skier equipped with the device according to the present invention for supporting a pair of skis.

Advantageously, the traction element 25 is a shoulder strap, as shown in FIG. 10.

A first end of the shoulder strap 25 is fixed to the rear part of a belt 32 which surrounds the skier's waist, and a second end is fixed to the element 11.

Figure 11:
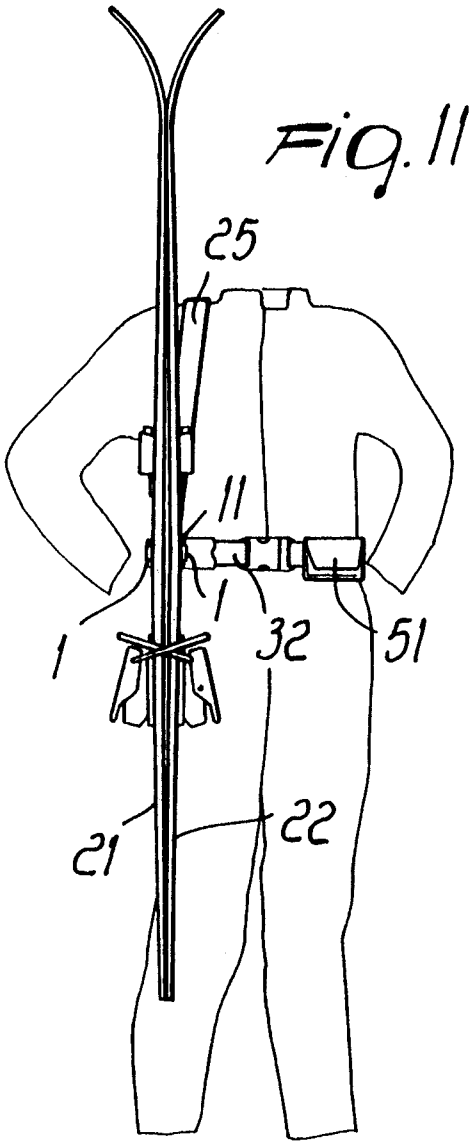
FIG. 11 is a view of a skier equipped with the device according to the present invention, without the pair of skis.

In order to retain the element 11 after it has been disengaged from the clasps 1, said element 11 is engaged in the element 27 located in the front part of the belt which corresponds to the strip 32, as shown in FIG. 11.

The following advantages are thus obtained:

A—when the skier has to carry the skis, he inserts the element 11 in the clasps 1 of a pair of skis 21 and 22 arranged so that the boot bindings are mutually opposite; therefore, it is advantageous for the clasps 1 to be fixed in a region which is very close to the center of gravity of the skis. In this manner the skier can support the skis 21 and 22, which assume the position most suitable for being carried without effort, since the shoulder strap 25 is supported by the skier's shoulder and is anchored to the belt 32.

B—When the skier wears the skis, the element 11 is inserted in the element 27 to fix the lower end of the shoulder strap 25.

C—The strap 25, and particularly the element 26 for adjusting its length, is suitable to support personal documents and/or the ski-pass 50 of the skier.

D—The belt 32 is associated with a bag 51 which accommodates the anti-theft device 34 of FIG. 9.

Figure 12:
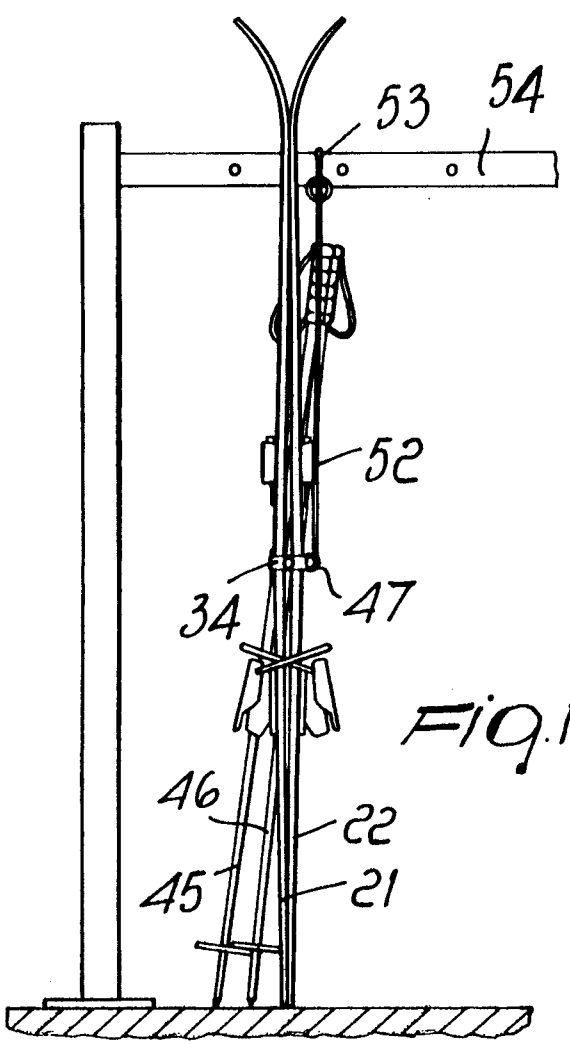
FIG. 12 is a view of a ski-rack.

E—Said anti-theft device is advantageously provided with a metallic chain 52 which has a ring 47 which is closed on the structure 35 and is strong enough to join said anti-theft device 34, preferably by means of a slip-knot formed by said chain, to a supporting element 53 of a ski-rack 54, as shown in FIG. 12.

Said slip-knots can be used to keep several pairs of skis together to protect them against possible theft.

The embodiment described is only one of the possible embodiments of the present invention, which is susceptible to extensive modifications.

The shapes, dimensions and materials employed do not limit the scope of the present invention, wherein each constructive element may be replaced with another technically equivalent element.

I claim:

1. A holder device, for holding at least one pair of elongated implements, comprising:

an anti-theft device (34) comprising a C-shaped structure (35) having a central portion and a pair of open side elements (36,37), said side elements extending substantially mutually parallel from said central portion, said side elements being provided with mutually facing sets of teeth (38,39) at end portions thereof, a first plate element (1) and a second plate element (1), each of said first and second plate elements comprising receiving means (24) for receiving a respective one of said side elements of said C-shaped structure;

connecting means (5,6,23) for connecting said first plate element to one (21) of said at least one pair of elongated implements and connecting means (5,6,23) for connecting said second plate element to another (22) of said at least one pair of elongated implements; and said first plate element and said second plate element being positionable in a mutually spaced relationship when said elongated implements are connected thereto such that both said side elements of said C-shaped structure are simultaneously insertable in said receiving means of both said first and second plate elements so that said sets of teeth extend out of said receiving means and past said elongated implements;

said anti-theft device further comprising:

a lock element (42) having bolt means (40,41) for releasably engaging in said sets of teeth at said end portions of said side elements of said C-shaped structure, thereby to lock said elongated implements in a space defined by said C-shaped structure and said lock element.

2. The holder device of claim 1, wherein said space defined by said C-shaped structure and said lock element is sufficient to hold a pair of skis.

3. The holder device of claim 1, wherein said space defined by said C-shaped structure and said lock element is sufficient to hold a pair of skis and a pair of ski poles (45,46) arranged near said pair of skis.

4. The holder device of claim 1, further comprising means (47,52,53) for hanging said anti-theft device on a ski rack (54).

5. A holder device, for holding at least one pair of elongated implements, comprising:

a male element (11) having substantially a U-shape, said male element comprising a central portion (12–14) and two arm portions (17,18), said two arm portions extending substantially mutually parallel from said central portion, said two arm portions being provided with elastically biased elements (15,16);

a first plate element (1) and a second plate element (1), each of said first and second plate elements comprising receiving means (24) for receiving a respective one of said two arm portions of said male element, and each of said first and said second plate elements comprising holding means (4,7) for holding in a releasable locked position a respective one of said elastically biased elements upon insertion of said arm portions in said receiving means;

connecting means (5,6,23) for connecting said first plate element to one (21) of said at least one pair of elongated implements and connecting means (5,6,23) for connecting said second plate element to another (22) of said at least one pair of elongated implements; and said first plate element and said second plate element being positionable in a mutually spaced relationship when said elongated implements are connected thereto such that both said arm portions of said male element are simultaneously insertable in said receiving means of both said first and second plate elements and such that both said elastically biased elements are releasably lockable in said holding means of both said first and second plate elements, thereby to allow to hold together the at least one pair of elongated implements;

the holder device further comprising:

carrying means (25,32) for carrying said male element; and means (12) for connecting said carrying means to said central portion of said male element.

6. The holder device of claim 5, wherein each of said first and second plate elements comprise a central wall portion (4) and a pair of lateral flap portions (2,3) connected to said central wall portion, said central wall portion being raised with respect to said flap portions by means of two raised walls (8,9) interconnected between said lateral flap portions and said central wall portion, said receiving means for each of said plate elements comprising a cavity defined by said central wall, said two raised walls, and a surface of a respective one of the elongated implements when said elongated implements are connected to said plate elements, said holding means comprising an opening (7) provided in said central wall portion in which one of said elastically biased elements is releasable engageable.

7. The holder device of claim 5, wherein each of said first and second plate elements comprise a central wall portion (4) and a pair of lateral flap portions (2,3) connected to said central wall portion, said central wall portion being raised with respect to said flap portions by means of two raised walls (8,9) interconnected between said lateral flap portions and said central wall portion, said receiving means for each of said plate elements comprising a cavity defined by said central wall, said two raised walls, and a surface of a respective one of the elongated implements when said elongated implements are connected to said plate elements, said holding means comprising an opening (7) provided in said central wall portion in which one of said elastically biased elements is releasable engageable, and wherein said connecting means comprise holes (5,6) provided in said flap portions and screw elements (23) engageable in said holes.

8. The holder device of claim 5, wherein said carrying means comprise a belt structure (25,32) carryable by a user, and wherein said means for connecting said carrying means to said central portion of said male element comprise a cylindrical pivot (12) provided at said central portion about which said belt structure (25) is slidably connected.

9. The holder device of claim 5, further comprising a female buckle element (27) in which said male element is releasably engageable when said male element is not inserted in said receiving means of said plate elements, said female buckle element being carried by said carrying means.

10. The holder device of claim 5, further comprising an anti-theft device (34), said anti-theft device comprising:

a C-shaped structure (35) having a central portion and a pair of open side elements (36,37), said side elements extending substantially mutually parallel from said central portion, said side elements being provided with mutually facing sets of teeth (38,39) at end portions thereof, said side elements being mutually spaced apart at a distance such that said side elements are simultaneously insertable in said receiving means of both said first and second plate elements when said plate elements are in said mutually spaced relationship, and such that said sets of teeth extend out of said receiving means and past said elongated implements; and a lock element (42) having bolt means (40,41) for releasably engaging in said sets of teeth at said end portions of said side elements of said C-shaped structure, thereby to lock said elongated implements in a space defined by said C-shaped structure and said lock element.

11. The holder device of claim 10, wherein said space defined by said C-shaped structure and said lock element is sufficient to hold a pair of skis.

12. The holder device of claim 10, wherein said space defined by said C-shaped structure and said lock element is sufficient to hold a pair of skis and a pair of ski poles (45,46) arranged near said pair of skis.

13. The holder device of claim 10, further comprising means (47,52,53) for hanging said anti-theft device on a ski rack (54).

14. The holder device of claim 5, further comprising an anti-theft device (34), said anti-theft device comprising:

a C-shaped structure (35) having a central portion and a pair of open side elements (36,37), said side elements extending substantially mutually parallel from said central portion, said side elements being provided with mutually facing sets of teeth (38,39) at end portions thereof, said side elements being mutually spaced apart at a distance such that said side elements are simultaneously insertable in said receiving means of both said first and second plate elements when said plate elements are in said mutually spaced relationship, and such that said sets of teeth extend out of said receiving means and past said elongated implements;

a lock element (42) having bolt means (40,41) for releasably engaging in said sets of teeth at said end portions of said side elements of said C-shaped structure, thereby to lock said elongated implements in a space defined by said C-shaped structure and said lock element; and means (51), carried by said carrying means, for holding said anti-theft device.

* * * * *